US011276976B2

(12) United States Patent
Masuda et al.

(10) Patent No.: US 11,276,976 B2
(45) Date of Patent: Mar. 15, 2022

(54) TERMINAL CRIMPING DEVICE AND TERMINAL CRIMPING METHOD

(71) Applicants: Yazaki Corporation, Tokyo (JP); Japan Chain Terminal Co., Ltd., Yamagata (JP)

(72) Inventors: Kousuke Masuda, Shizuoka (JP); Yuji Takahashi, Yamagata (JP); Akiya Numazawa, Yamagata (JP)

(73) Assignees: YAZAKI CORPORATION, Tokyo (JP); JAPAN CHAIN TERMINAL CO., LTD., Yamagata (JP)

( * ) Notice: Subject to any disclaimer, the term of this patent is extended or adjusted under 35 U.S.C. 154(b) by 223 days.

(21) Appl. No.: 16/515,706

(22) Filed: Jul. 18, 2019

(65) Prior Publication Data

US 2020/0044404 A1 Feb. 6, 2020

(30) Foreign Application Priority Data

Aug. 2, 2018 (JP) ..... JP2018-145538

(51) Int. Cl.
*H01R 43/052* (2006.01)
*H01R 43/055* (2006.01)

(52) U.S. Cl.
CPC ..... *H01R 43/052* (2013.01); *H01R 43/055* (2013.01)

(58) Field of Classification Search
CPC ..... H01R 43/052; H01R 43/055
See application file for complete search history.

(56) References Cited

FOREIGN PATENT DOCUMENTS

| | | | |
|---|---|---|---|
| CN | 2462581 Y | * | 11/2001 |
| JP | 01-012792 Y | * | 1/1989 |
| JP | 02-055911 B | * | 11/1990 |
| JP | 5-326055 A | | 12/1993 |
| JP | 8069720 A | * | 3/1996 |
| JP | 3530045 B | * | 4/2000 |
| JP | 2010-3429 A | | 1/2010 |
| JP | 2018-88351 A | | 6/2018 |

* cited by examiner

*Primary Examiner* — Carl J Arbes
(74) *Attorney, Agent, or Firm* — Kenealy Vaidya LLP

(57) ABSTRACT

Terminal crimping device and terminal crimping method is provided that collectively crimp-connects a terminal to an electric wire while suppressing displacement of the terminal at a crimp position. A terminal crimping device includes a cutting part configured to cut from the carrier each of the two or more terminals belonging to one terminal set at one end side in the terminal coupled body; a terminal conveyance part configured to convey the two or more terminals cut at the cutting part to a crimp position corresponding to the predetermined interval while adjusting a terminal interval of the two or more terminals to an arrangement interval of the covered electric wire at the crimp position in a conveyance direction (longitudinal direction) of the terminal coupled body; and a crimping part configured to collectively crimp-connect to the electric wire each of the two or more terminals conveyed to the crimp position.

13 Claims, 7 Drawing Sheets

TERMINAL CRIMPING DEVICE AND TERMINAL CRIMPING METHOD

BACKGROUND OF THE INVENTION

Field of the Invention

The present invention relates to a terminal crimping device and a terminal crimping method for crimp-connecting to an electric wire each terminal of a terminal coupled body in which a plurality of terminals is coupled by a band plate carrier.

Description of the Related Art

Conventionally, technology is known in which a terminal coupled body in which a plurality of terminals is coupled by a band plate carrier is supplied as a material and which crimp-connects each terminal in the terminal coupled body to an electric wire (for example, see Patent Literature 1).

In the technology described in Patent Literature 1, the plurality of terminals coupled by the carrier is collectively crimp-connected to the wire. At this time, a terminal interval in the terminal coupled body and an interval of the electric wire arranged according to a terminal arrangement etc. in a connector for example in a crimp position do not often coincide. In the technique described in Patent Literature 1, the terminal interval in the terminal coupled body is wider than the interval of the electric wire at the crimp position. For this reason, in the technique described in Patent Literature 1, prior to crimp-connection, in order to adjust a mutual interval of the terminals to the alignment interval of the electric wires, a coupled part located between terminals in the carrier is bent to shorten the terminal interval.

PATENT LITERATURE

Patent Literature 1: JP-A-2010-003429

SUMMARY OF THE INVENTION

However, due to internal stress and the like accumulated in the carrier due to bending the coupled part as described above, the carrier may be deformed at the crimp position, which may cause displacement of the terminals.

Therefore, the present invention, focusing on the above problems, aims to provide a terminal crimping device and a terminal crimping method capable of suppressing the displacement of the terminal at the crimp position and collectively crimp-connect the terminal to an electric wire.

In order to solve the above-mentioned problems, the terminal crimping device of the present invention is a terminal crimping device for crimp-connecting to an electric wire arranged at a predetermined interval each terminal of a terminal coupled body in which a plurality of terminals is connected such that each extends from one side edge of a band plate carrier, including: a cutting part, provided that the plurality of terminals is divided into a plurality of terminal sets for every two or more terminals adjacent to each other, configured to cut from the carrier each of the two or more terminals belonging to one terminal set at one end side in the terminal coupled body; a terminal conveyance part configured to convey the two or more terminals cut at the cutting part to a crimp position corresponding to the interval while adjusting a terminal interval of the two or more terminals to the predetermined interval in a longitudinal direction of the terminal coupled body; and a crimping part configured to collectively crimp-connect to the electric wire each of the two or more terminals conveyed to the crimp position.

Moreover, in order to solve the problems, the terminal crimping method of the present invention is a terminal crimp method of crimp-connecting to an electric wire arranged at a predetermined interval each terminal of a terminal coupled body in which a plurality of terminals is connected such that each extends from one side edge of a band plate carrier, including the steps of: a cutting step of cutting, provided that the plurality of terminals is divided into a plurality of terminal sets for every two or more terminals adjacent to each other, from the carrier each of the two or more terminals belonging to one terminal set at one end side in the terminal coupled body; a terminal conveyance step of conveying the two or more terminals cut at the cutting step to a crimp position corresponding to the interval while adjusting terminal interval of the two or more terminals to the predetermined interval in a longitudinal direction of the terminal coupled body; and a crimping step of collectively crimp-connecting to the electric wire each of the two or more terminals conveyed to the crimp position.

In the terminal crimping device and the terminal crimping method of the present invention, the terminal interval of two or more terminals provided for crimping is adjusted to the interval of the electric wire by cutting and conveying from the carrier, and crimping takes place with the terminal being separated from the carrier. For this reason, since the terminal will be subjected to crimping in a state released from the influence of an internal stress etc. accumulated in the carrier, displacement of the terminal at the crimp position can be suppressed so as to perform collective crimp-connection to the electric wire.

DETAILED DESCRIPTION OF THE PREFERRED EMBODIMENTS

Hereinafter, an embodiment of the present invention will be described.

Figure 1:
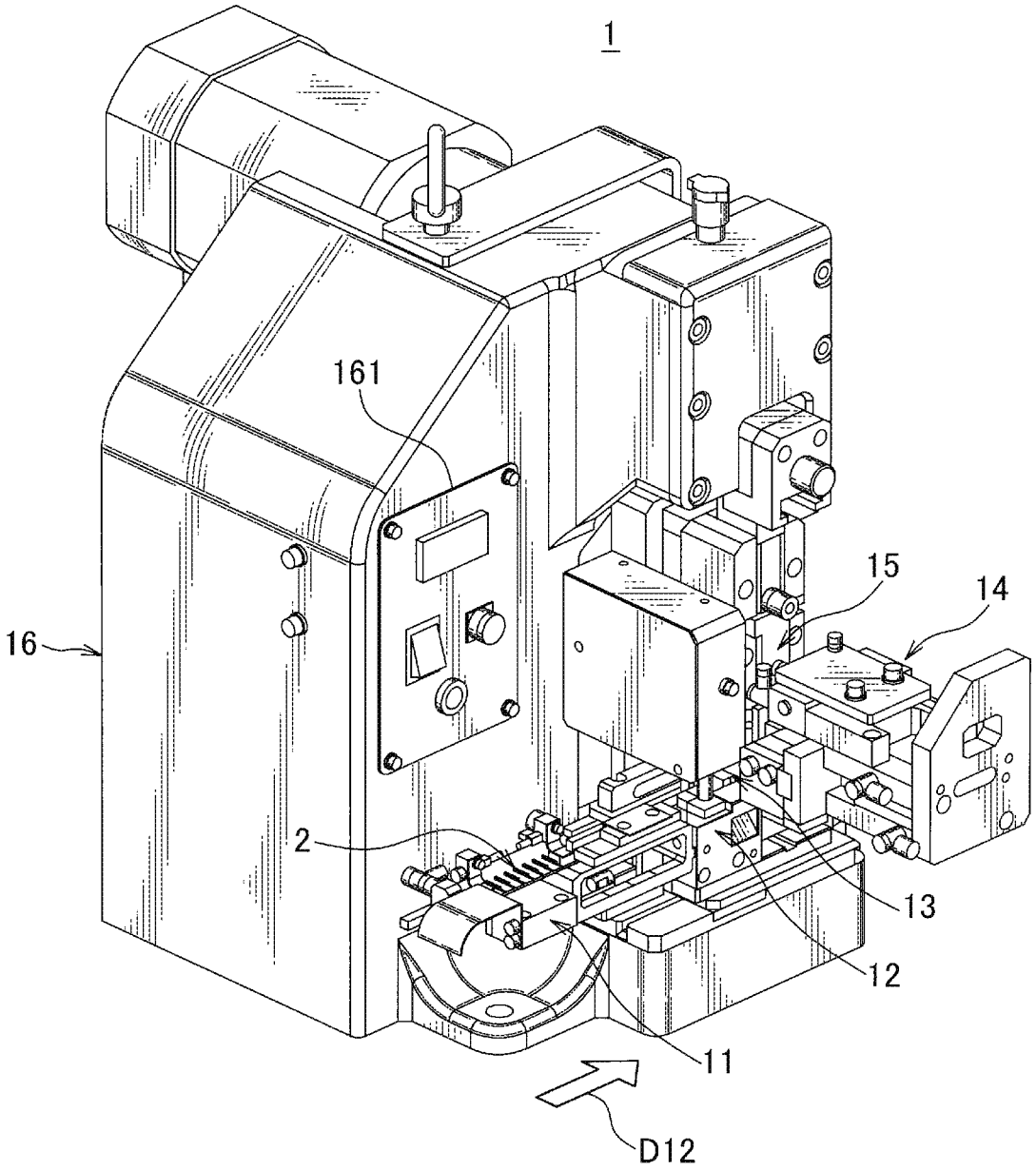
FIG. 1 is a view showing a terminal crimping device according to an embodiment of the present invention.
Figure 2:
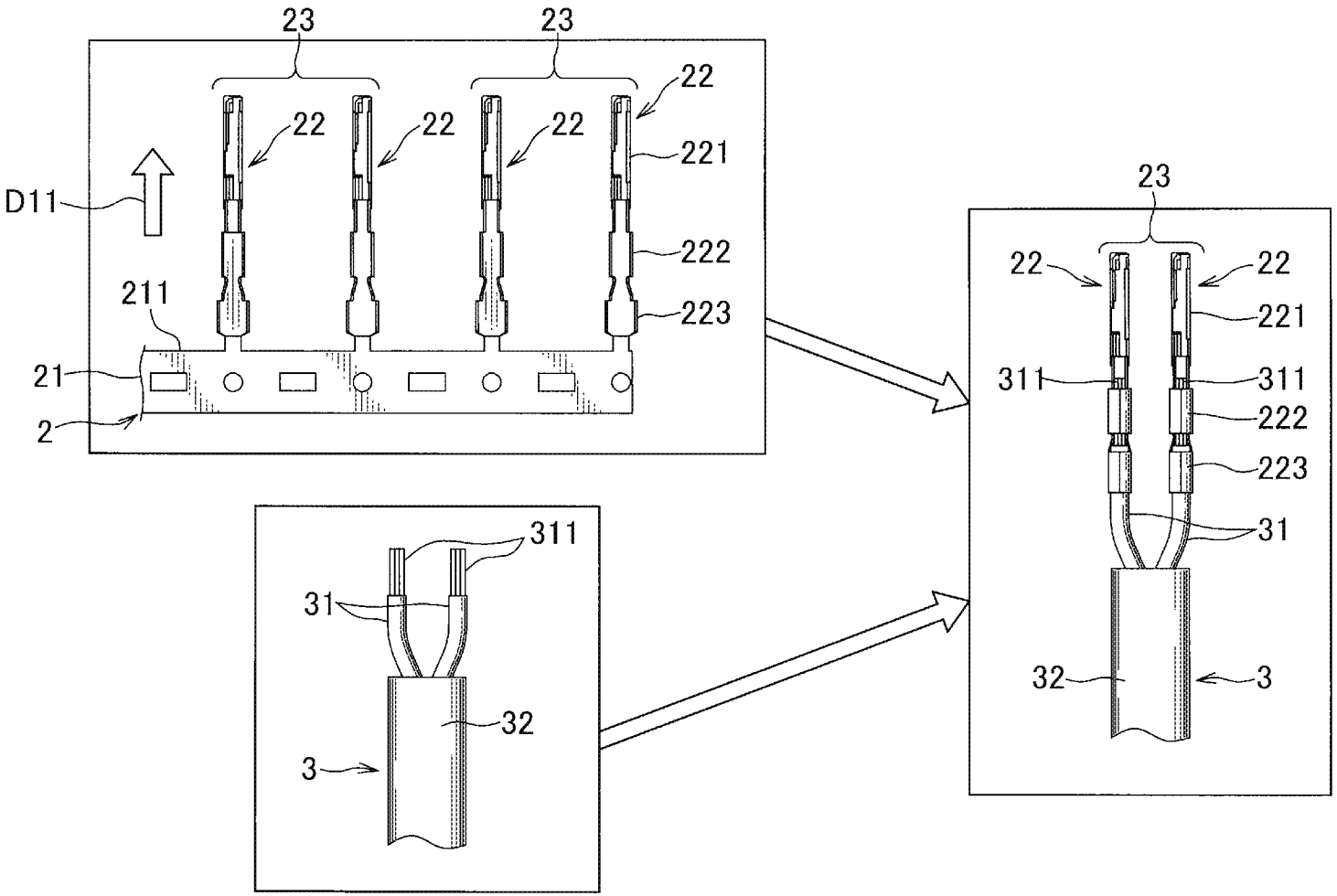
FIG. 2 is a schematic view showing a step performed by the terminal crimping device shown in FIG. 1.

FIG. 1 is a view showing a terminal crimping device according to an embodiment of the present invention. Also, FIG. 2 is a schematic view showing a step performed by the terminal crimping device shown in FIG. 1.

The terminal crimping device 1 in the present embodiment is a device of crimp-connecting each terminal 22 of a terminal coupled body 2 in which a plurality of terminals 22 is coupled by a carrier 21 to a pair of covered electric wires 31 (electric wires) arranged at a predetermined interval at a crimp position of a multicore cable 3.

In the present embodiment, the multicore cable 3 is a two-core cable, and the pair of covered electric wires 31 is covered with an insulating sheath 32. The insulating sheath 32 at one end of multi-core cable 3 is removed and a pair of covered electric wire 31 is exposed, and a covered of an end of each covered electric wire 31 is removed and a conductor part 311 is exposed. A terminal 22 is crimp-connected to an end including the conductor part 311 of each covered wire 31.

The terminal coupled body 2 is the one in which a plurality of terminals 22 is coupled such that each extends from a side edge 211 of the strip-shaped carrier 21 in an extending direction D11 crossing the side edge 211 along an in-plane direction. Each terminal 22 is a female-type terminal accommodated in a connector (not shown), and includes a cylindrical electric connection part 221 to which a male terminal of the other party is inserted and connected, a conductor crimp part 222, and a cover crimp part 223. The conductor crimp part 222 is swaged and crimped to the conductor part 311 exposed to the end of the covered wire 31. The cover crimp part 223 is swaged and crimped to a covered part adjacent to the conductor part 311. Crimping the two crimped parts crimp-connects the terminal 22 to the covered electric wire 31.

The terminal coupled body 2 is wound on a reel (not shown), and supplied to the terminal crimping device 1 from this reel. The terminal crimping device 1 feeds out the terminal connector 2 in a predetermined conveyance direction D12 to crimp-connect each terminal 22 connected to the carrier 21 to the covered wire 31. Here, in the present embodiment, the terminals 22 are collectively crimped on a pair of covered electric wires 31 in the multicore cable 3. The terminal crimping device 1, provided that the plurality of terminals 22 in the terminal coupled body 2 is divided into a plurality of terminal sets 23 every two terminals 22 adjacent to each other, sequentially crimp-connects from the terminal set 23 located at the front end in the conveyance direction D12. Two terminals 22 belonging to each terminal set 23 are collectively crimp-connected to the pair of covered electric wires 31. Also those two terminals 22 are disconnected from carrier 21.

The terminal crimping device 1 includes a terminal coupled body conveyance part 11, a cutting part 12, a terminal conveyance part 13, a wire set part 14, a crimping part 15, and a drive control part 16.

The terminal coupled body conveyance part 11 feeds out the terminal coupled body 2 from a reel (not shown) and conveys it in a predetermined conveyance direction D12. The cutting part 12 cut the two terminals 22 belonging to the terminal set 23 at the front end of the terminal connector 2 from the carrier 21. The terminal conveyance part 13 conveys the two cut terminals 22 to a crimp position where the pair of covered electric wires 31 is arranged at a predetermined interval. The wire setting part 14 sets an end part including the conductor part 311 of the pair of covered electric wires 31 in the multicore cable 3 to the two terminals 22 conveyed. The crimp part 15 collectively crimp-connects the two terminals 22 to the end of the pair of covered wires 31. The drive control part 16 has an operation panel 161 operated by the user, and in response to the operation on the operation panel 161, controls the operation of each of the above-mentioned parts in the terminal coupled body conveyance part 11.

Figure 3:
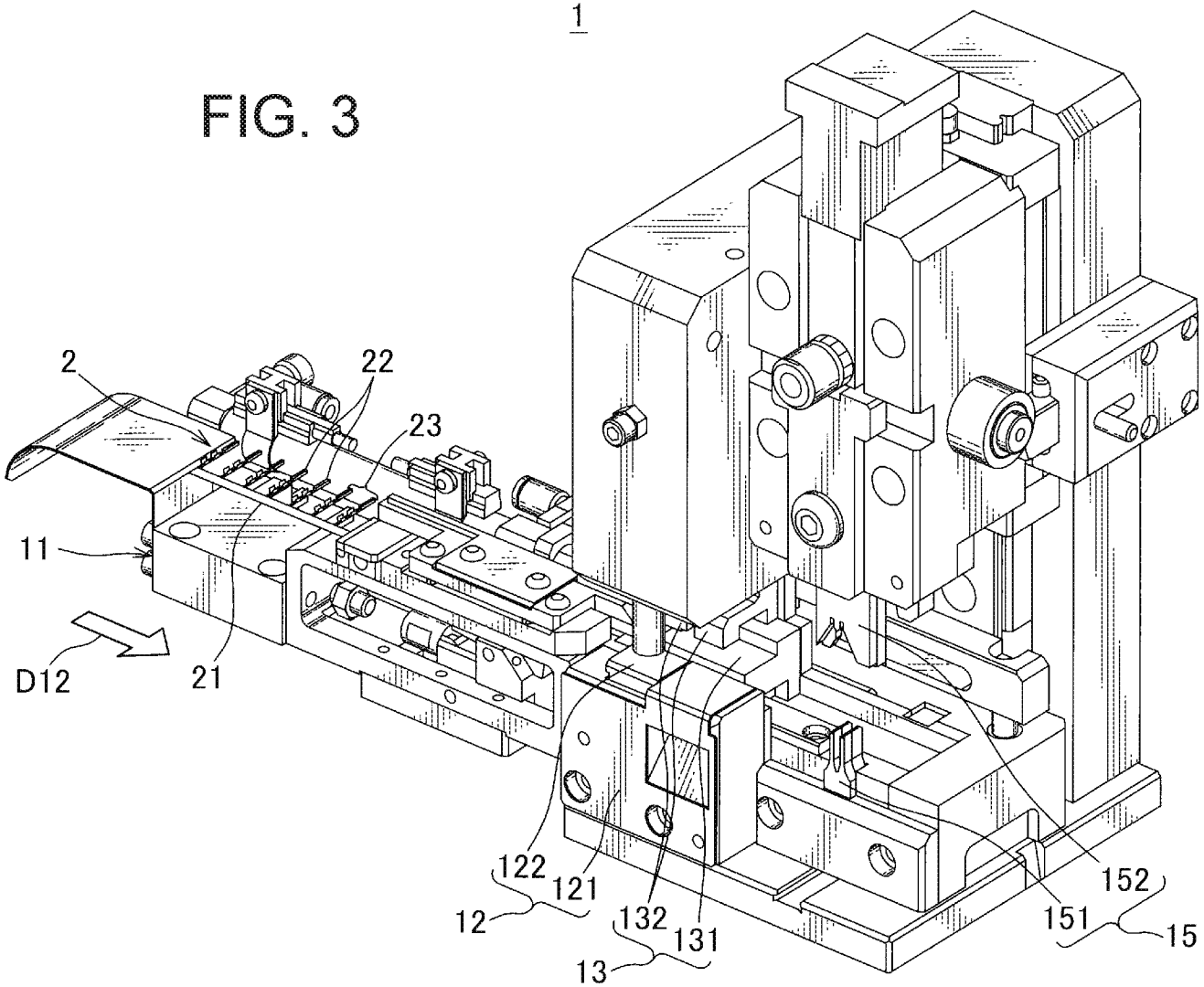
FIG. 3 is a view showing the terminal crimping device shown in FIG. 1 removing a terminal coupled body conveyer, a cutting part, a terminal conveyance part, and parts other than a crimping part.
Figure 4:
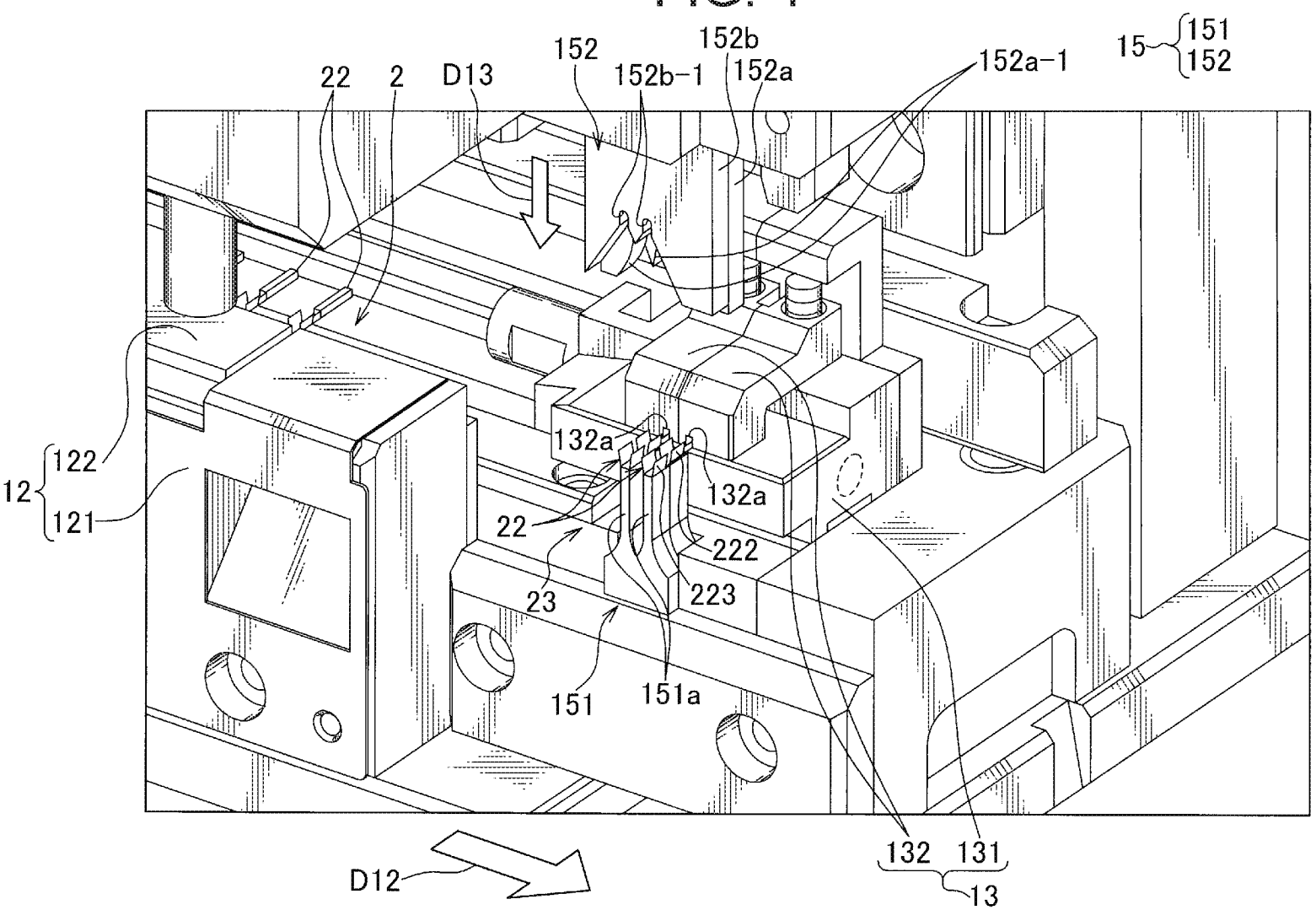
FIG. 4 is an enlarged view of the terminal conveyance part and the crimping part shown in FIG. 3.

FIG. 3 is a view showing the terminal crimping device shown in FIG. 1 removing the terminal coupled body conveyance part, the cutting part, the terminal conveyer, and parts other than the crimping part. FIG. 4 is an enlarged view of the terminal conveyance part and the crimping part shown in FIG. 3. Note that FIG. 3 shows a state before cutting of the terminal 22, and FIG. 4 a state of cutting of the terminal 22 from the carrier 21 and being conveyed to the crimp position.

As described above, the terminal coupled body conveyance part 11 conveys the terminal coupled body 2 in the conveyance direction D12. This conveyance performs such that the terminal set 23 in the terminal connector 2 is conveyed to the cutting part 12 one by one set.

The cutting part 12 cuts from the carrier 21 two terminals 22 in the terminal set 23 which is fed in one by one set. The cutting part 12 has a lower part 121 with an upward blade, and an upper part 122 for pressing the terminal set 23 toward the blade, so-called shear blade. In addition, in the cutting part 12, the two terminals 22 are cut from the carrier 21, and the end part of the carrier 21 from which the terminal 22 is also cut.

The terminal conveyance part 13 conveys the two terminals 22 cut by the cutting part 12 to the crimp position in the crimping part 15 in the longitudinal direction of the terminal connector 2, that is, the above-described conveyance direction D12. Terminal conveyance part 13 includes a pedestal part 131 and two terminal holding arms 132 (conveyance parts). Each terminal holding arm 132 holds the terminals 22 so as to sandwich with the pedestal part 131 each terminal 22. In the surface of the terminal holding arm 132 opposite to the pedestal part 131, a groove 132*a* is formed in which the electric connection part 221 in the terminal 22 is to be accommodated. The terminal holding arm 132 is configured to receive in the groove 132*a* the electric connection part 221. The pedestal part 131 and the two terminal holding arms 132 move in the direction D12 in such holding state and thus the two terminals 22 are conveyed.

At this time, the terminal conveyance part 13 is configured slidable between the cut position of the terminal 22 by the cutting part 12 shown in FIG. 3 and the crimp position by the crimping part 15 shown in FIG. 4. And in the terminal conveyance part 13, each of the two terminals 22 is held prior to cutting of each of the two terminals 22 from the carrier 21 by the cutting part 12 at the cut position, and after cutting, the two terminals 22 are conveyed to the crimp position while maintaining the holding state. Since the two terminals 22 are held prior to cutting, in this terminal conveyance part 13, the terminal 22 are held spacing a terminal interval of terminal 22 in the terminal connector 2.

Here, in the present embodiment, a pair of covered electric wires 31 arranged at intervals according to the terminal arrangement in a small connector at the crimp position is crimp-connected at the crimp part 15. At this time, the terminal interval in the terminal connection 2 supplied as material is wider than the interval of the arrangement of the covered electric wire 31, i.e. the crimp interval. Therefore, in the present embodiment, the terminal conveyance part 13 which holds the two terminals 22 at the terminal interval of the terminal connector 2 conveys the two terminals 22 to the crimp position while shortening to match the above-mentioned crimp interval.

In the present embodiment, as shown in FIG. 3, two terminal holding arms 132 can slide from the state of being separated according to the terminal interval 2 as shown in FIG. 4 to abutting to each other as shown in FIG. 4. When the terminal holding arms 132 abut to each other, the terminal interval of the two terminals 22 held by the terminal holding arm 132 is set equal to the above-mentioned crimp interval.

In this terminal conveyance part 13, the terminal holding arm 132 is set to move in the conveyance direction D12 so that the following terminal holding arm 132 abuts on the leading terminal holding arm 132 at a timing at which the leading terminal holding arm 132 reaches the crimp position. Such movement of the two terminal holding arms 132 allows the terminal conveyance part 13 to convey the two terminals 22 to the crimp position in the longitudinal direction of the terminal connector 2 (i.e., the conveyance direction D12) while shortening the terminal interval. In addition, the terminal holding arm 132 at this time moves such that the two terminals 22 arrive at the crimp position at the same timing.

The crimping part 15 collectively crimp-connects to an end of the covered wire 31 each of the two terminals 22 conveyed to the crimp position. The crimping part 15 includes an anvil 151 and a crimper 152.

The anvil 151 has two rows of support bases 151*a* for supporting the two terminals 22 from below. The terminal conveyance part 13 conveys such that the conductor crimp part 222 and the cover crimp part 223 in the two terminals 22 held as described above are mounted on the two rows of the support bases 151*a*. Shortening of the terminal interval by the two terminal holding arms 132 is to shorten the terminal interval in the terminal coupled body 2 so as to match the arrangement interval of the two rows of supports 151*a*.

At this time, the arrangement interval of the two rows of support bases 151*a* in the anvil 151 corresponds to the interval of the arrangement of the pair of covered electric wires 31 at the time of crimping, that is, the crimp interval. And this interval between the covered electric wires 31 corresponds to terminal arrangement in the connector (not shown) in which the two terminals 22 after crimping are accommodated.

The crimper 152 includes a conductor crimper 152*a* for crimping the conductor crimp part 222 of the terminal 22, and a covered crimper 152*b* for crimping the cover crimp part 223. The conductor crimper 152*a* and the covered crimper 152*b* are arranged from the front side to the back side of FIG. 4 in the order of the crimper 152*b* and the conductor crimper 152*a* depending on the positions of the conductor crimp part 222 and the cover crimp part 223 at the terminal 22 on the support base 151*a*. The conductor crimper 152*a* is provided with two conductor recesses 152*a*-1 for receiving the conductor crimp part 222 of each of the two terminals 22 placed on the two rows of support bases 151*a*. Also, the covered crimper 152*b* is provided with two cover recesses 152*b*-1 for receiving the covered crimps 223 of each of the two terminals 22.

When the two terminals 22 and the ends of the pair of covered wires 31 are set on the two rows of support bases 151*a*, the conductor crimper 152*a* and the covered crimper 152*b* together descend toward the terminals 22 and the end of the covered electric wire 31 in the crimping direction D13. This descent causes each cover crimp part 223 to fit in each cover recess 152*b*-1 of the conductor crimper 152*b*, and each conductor crimp part 222 to fit in each conductor recess 152*a*-1 of the conductor crimper 152*a*. After being settled, the conductor crimper 152*a* and the covered crimper 152*b* continue to apply a constant pressure force in the pressing direction D13, and thus the conductor crimp part 222 and the cover crimp part 223 are crimped.

Also, the end part of the covered wire 31 with respect to the terminal 22 set to such a crimp part 15 is arranged by the wire setting part 14.

The wire setting part 14 holds a part of the insulating sheath 32 in the multicore cable 3 such that the end of the pair of covered electric wires 31 that exposes from one end is directed to the crimping part 15. And the two terminals 22 belonging to one terminal set 23 move toward the crimping part 15 when placed on the two rows of support bases 151*a* in the anvil 151 by the terminal coupled body conveyance part 11. This movement is performed such that the conductor part 311 at the end of the pair of covered wires 31 is placed on the conductor crimp part 222 of the two terminals 22.

Then, when the ends of the pair of covered wires 31 are completely set by the wire setting part 14, the crimper 152 descends at the fitting part 15 in the crimping direction D13 to crimp-connect.

In the present embodiment, the terminal conveyance part 13 maintains holding the two terminals 22 until the crimp-connection by the crimp part 15 is completed. This enables crimp-connection to be performed with the two terminals 22 being stably held.

Next, a terminal crimping method performed by the terminal crimping device 1 described above, although partly overlapping with the description, will be described again with reference to other drawings.

In this terminal crimping method, firstly terminal coupled body conveyance step in which one terminal set 23 in the terminal coupled connector 2 is conveyed to the cutting part 12, and following cutting step and terminal conveyance step are sequentially performed.

Figure 5:
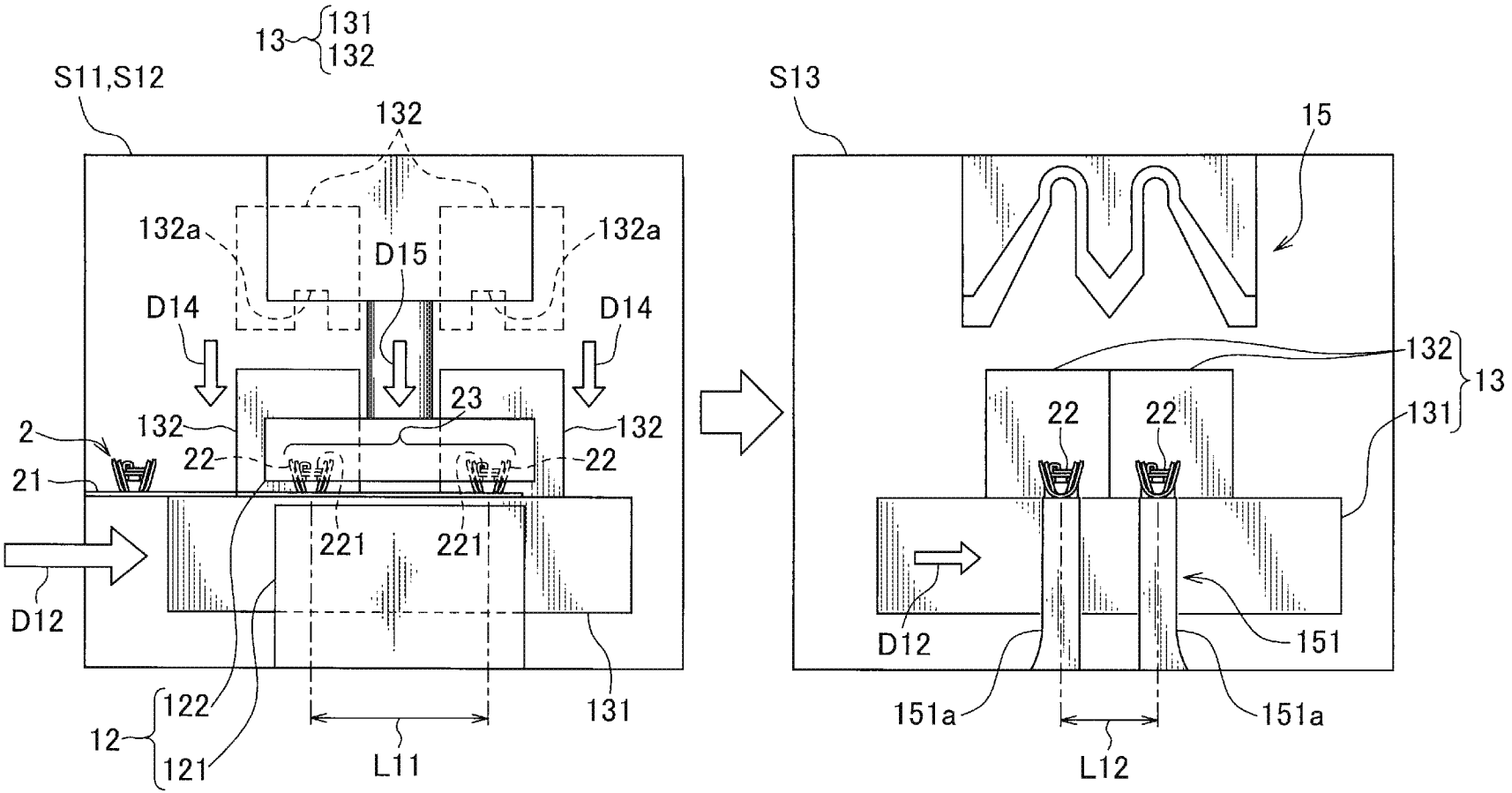
FIG. 5 is a schematic view showing a terminal coupled body conveyance step, a cutting step, and a terminal conveyance step to be performed in the method by the crimping device shown in FIGS. 1 to 4.

FIG. 5 is a schematic view showing a terminal coupled body conveyance step, a cutting step, and a terminal conveyance step to be performed in the method by the crimping device shown in FIGS. 1 to 4.

First, in the terminal coupled body conveyance step (S11), the terminal coupled body conveying part 11 conveys the terminal coupled body 2 in the conveyance direction D12, and one terminal set 23 at the front end is fed to the cutting part 12. In the stage of the terminal coupled body conveyance step (S11), the upper part 122 of the cutting part 12 retracts above the lower part 121 so as not to impede the progress of the terminal set 23. Also at the same time, the terminal conveyance part 13 is disposed at a position adjacent to the cutting part 12 and the terminal holding arm 132 retracts to a retracted position indicated by the dotted line above the pedestal part 131 so that the terminal set 23 is not impeded to move. The terminal set 23 is conveyed so that the carrier 21 is located in the gap between the upper part 122 and the lower part 121 of the cutting part 12 and the two terminals 22 is located between the two terminal holding arms 132 and the pedestal part 131 of the terminal conveyance part 13.

In the next cutting step (S12), first, the two terminal holding arms 132 descends from the retracted position in the arrowed D14 direction, and accommodates the electric connection part 221 in the groove 132*a* of each terminal holding arm 132, sandwiching it with the pedestal part 131. Thereby, the two terminals 22 are held by the terminal conveyance part 13. Subsequently, the upper part 122 of the cutting part 12 descends in the direction of the arrow D15 to press the terminal set 23 toward the upward blade in the lower part 121. This pressure cuts the two terminals 22 from the carrier 21. At this time, the end where the terminal 22 is cut in the carrier 21 is also cut together.

Subsequent to the cutting step (S12), the terminal conveyance part 13 performs the terminal conveyance step (S13). In the terminal conveyance step (S13), as described above, the terminal conveyance part 13 conveys in the conveyance direction D12 the two terminals 22 cut in the cutting step (S12) to the crimp position in the crimping part 15 while shortening the terminal interval of these two terminals 22. This crimp position is a position where the two terminals 22 are placed on the two rows of support bases 151*a* in the anvil 151. The terminal interval in the terminal conveyance step (S13) is shortened by two terminal holding arms 132 which were spaced from each other at the end of the cutting step (S12) moving on the pedestal part 131 to abut. This abutment is, as mentioned above, the following terminal holding arm 132 abuts on the leading terminal holding arm 132 generally at the same time of the leading terminal holding arm 132 reaching the crimp position. This terminal conveyance step (S13) allows the terminal interval L11 of the two terminals 22 before shortening that is just the terminal interval in the terminal coupled body 2 at the end of the cutting step (S12) to be shortened to the terminal interval L12 after shortening corresponding to the interval of the two rows of the support base 151*a* of the anvil 151. After the terminal conveyance step (S13), the wire setting step 14 is performed by the wire setting part 14.

Figure 6:
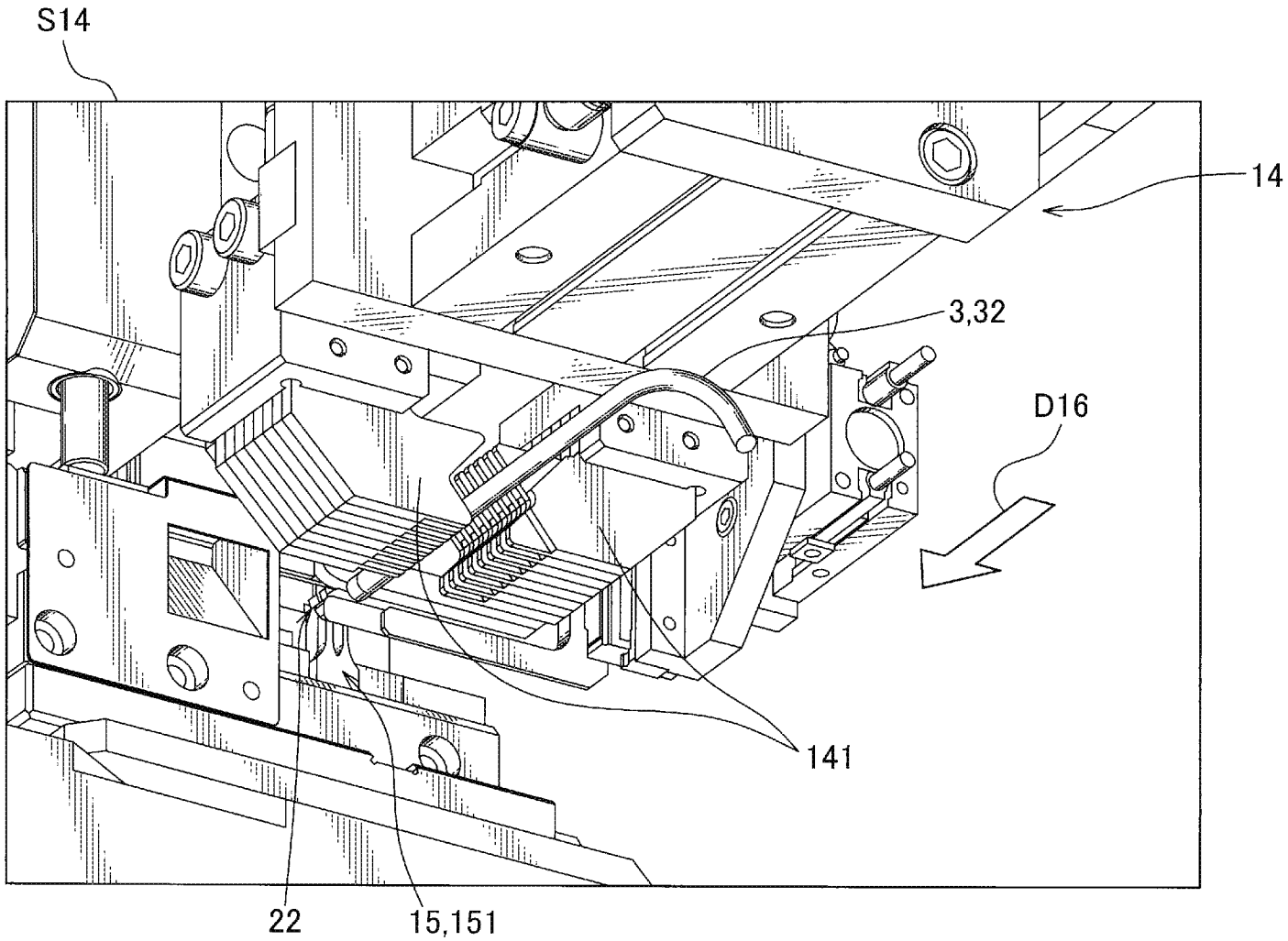
FIG. 6 is a view showing an electric wire setting step to be performed in the method by the crimping device shown in FIGS. 1 to 4.

FIG. 6 is a view showing an electric wire setting step to be performed in the method by the crimping device shown in FIGS. 1 to 4.

The wire setting part 14 includes a wire holding part 141 sandwiching and holding a part of the insulating sheath 32 in the multicore cable 3. In the wire setting step (S14), the wire holding part 141 of the wire setting part 14 holds the part of the insulating sheath 32 in the multi-core cable 3 such that the pair of covered electric wires 31 goes to the crimping part 15. And the wire holding part 141 moves toward the crimping part 15 in the wire setting direction D16 so that the conductor part 311 at the end of the covered wire 31 is placed on the conductor crimp part 222 of the terminal 22 that is placed on the support base 151*a* of the anvil 151. In the wire setting step (S14), the conductor part 311 is placed on the conductor crimp part 222, and the crimping step is performed at the crimping part 15.

Figure 7:
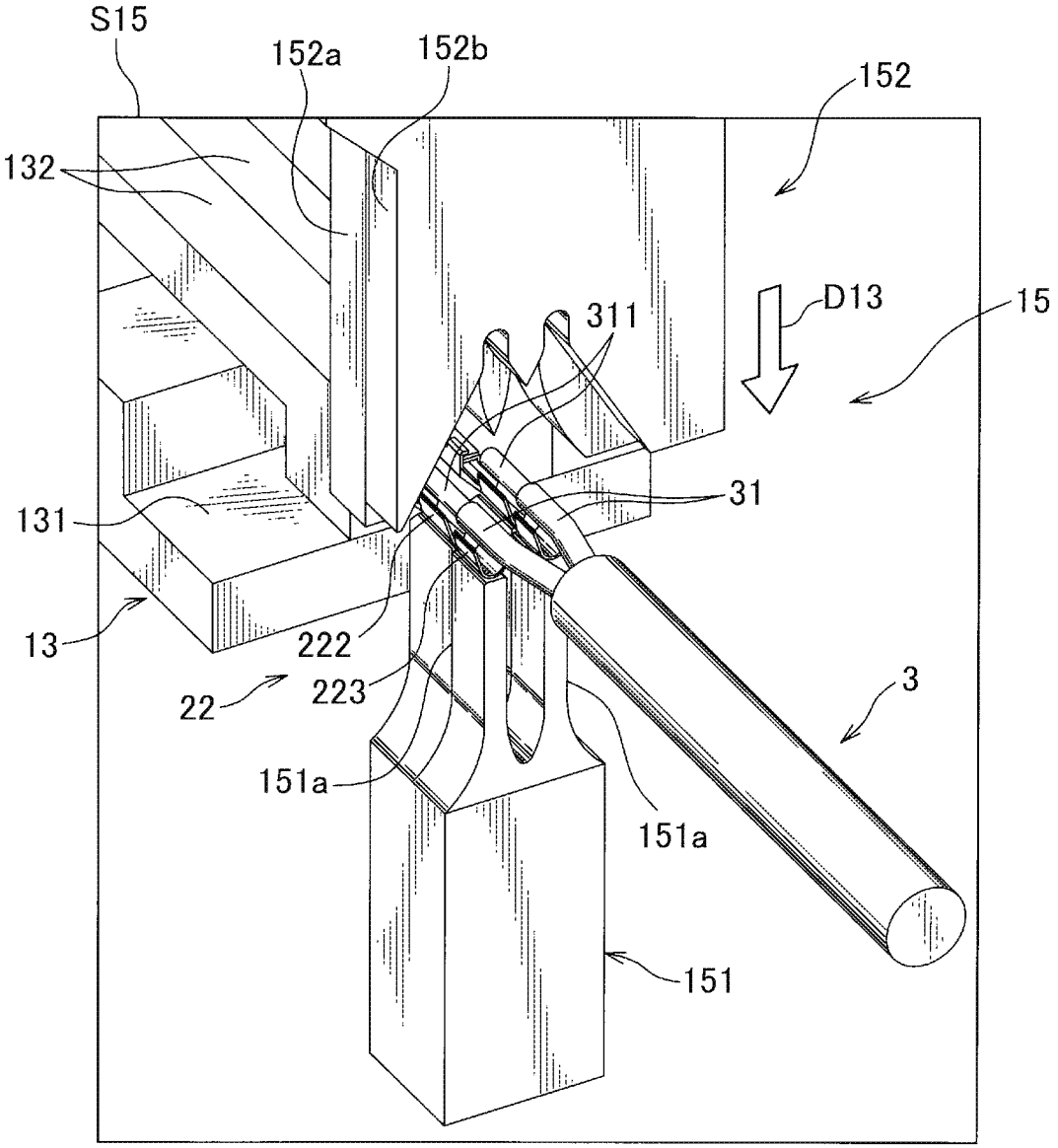
FIG. 7 is a view showing a crimping step to be performed in the method by the crimping device shown in FIGS. 1 to 4.

FIG. 7 is a view showing a crimping step to be performed in the method by the crimping device shown in FIGS. 1 to 4.

In the crimping step (S15) shown in FIG. 7, in the crimping part 15, the crimper 152 descends in the crimping direction D13 toward the two terminals 22 mounted on the two rows of support bases 151*a* of the anvil 151, and the end of the electric wire 31 of the multicore cable 3. This descent allows the conductor crimp part 222 of each terminal 22 to be crimped to the body part 311 of the conductor wire 31 by the conductor crimper 152*a*, and the crimped part 223 to be crimped to a covered part of the covered electric wire 31 by the covered crimper 152*b*. Thereby, each of the two terminals 22 is collectively crimp-connected to the pair of covered electric wires 31. The two terminal holding arms 132 in the terminal conveyance part 13 keeps the holding state sandwiching each terminal 22 with the pedestal part 131 until the crimping step (S15) is completed.

When the crimping step (S15) is completed, the crimper 152 and the two terminal holding arms 132 ascend to release the two terminals 22. In addition, the terminal conveyance part 13 returns to the cut position of the terminal 22 at the cutting part 12, preparing crimp step for the two terminals 22 belonging to the next terminal set 23.

In the terminal crimping device 1 and the terminal crimping method of the present embodiment described above, the terminal interval between the two terminals 22 provided to the crimping is adjusted to the interval of the pair of covered electric wire 31 by cutting and conveying from the carrier 21, and the crimping is performed in a state that the terminal 22 is cut and released from the carrier 21. Therefore, since the terminal 22 is provided to the crimping, with being released from an influence of internal stress and the like accumulated in the carrier 21, it is possible to suppress the positional displacement of the terminal 22 at the crimp position and collectively crimp-connect to the covered electric wire 31.

Here, in the present embodiment, the terminal interval of the plurality of terminals 22 in the terminal connector 2 is wider than the interval of arrangement of the pair of covered electric wires 31 in the crimp position. Then, the terminal conveyance part 13 shortens the terminal interval of the two terminals 22 to match the interval of the covered wire 31.

Taken as the multicore cable 3 described above are a twisted cable in which a pair of covered electric wires 31 is twisted inside the insulating sheath 32, a shielded cable shielded between the insulated sheath 32 and the covered wire 31 and the like. These cables are high-frequency cable used to transmit a high frequency signal which is shielded for the purpose of improving high-frequency characteristics, etc. through noise reduction. In such a high frequency cable, an exposed portion where the insulating sheath 32 is removed suffers degradation of the noise reduction effect, and of high frequency characteristics as a result. For this reason, it is desirable for high frequency cables to keep the exposure length as short as possible even if the covered wire 31 must be exposed to some extent due to crimp-connection of the terminal 22 or a subsequent insertion into the connector.

In the present embodiment, as for the terminal set 23 set in the crimping part 15 as described above, since the terminal interval is shortened, exposure length and wire interval can be short when the pair of covered electric wires 31 are exposed from the insulating sheath 32 and divided into two. For this reason, according to the present embodiment, it is also possible to crimp-connect the terminal 22 to the covered wire 31 of the high frequency cable while suppressing degradation of high frequency characteristics.

Further, in the present embodiment, the terminal conveyance part 13 includes two terminal holding arms 132 conveying each of the two terminals 22 individually. Thus, the terminal holding arm 132 conveys the terminals 22 individually, preferably making it easy to adjust the interval between the terminals 22 that move individually.

Further, in the present embodiment, the terminal conveyance part 13 holds each of the terminals 22 prior to cutting off from the carrier 21 each of the two terminals by the cutting part 12, and, after cutting, the terminals 22 are conveyed to the crimp position while maintaining the holding state. Thereby, the terminal 22 is held for stabilizing the terminal 22 at the time of cutting at the cutting part 12 by the terminal conveyance part 13. Thus, according to the present embodiment, since the role of terminal stabilization at the time of cutting is also served by the terminal conveyance part 13, the device structure can be simplified, and the cost of the device can be reduced as compared with the case of providing separately a structure for terminal stability.

Further, in the present embodiment, the terminal conveyance part 13 maintains the holding state of the terminal 22 until the crimp connection by the crimp part 15 is completed. Thus, since the role of stabilizing the terminal 22 at the time of crimping is also served by the terminal conveyance part 13, the device cost can be further suppressed.

Further, in the present embodiment, the terminal conveyance part 13 conveys the two terminals 22 so as to arrive at the crimp position in the same timing position. Since the two terminals 22 arrive at the crimp position at the same time, it is easy to set the start timing of the subsequent crimping, and it is possible to simplify operation control in the terminal crimping device 1, reducing device cost.

The embodiment described above only shows a typical form of the present invention, but the present invention is not limited to this. That is, various modifications can be made without departing from the scope of the present invention. Also this modification, as far as including a configuration according to the terminal crimping device and the terminal crimping method of the present invention, is included in the scope of the present invention.

For example, in the embodiment described above, as an example of the terminal crimping device and the terminal crimping method according to the present invention, the terminal crimping device 1 and the terminal crimping method are illustrated that the two terminals 22 are collectively crimp-connected as the two terminals 22 taken as the terminal set 23. However, the crimping device and the terminal crimping method referred to in the present invention are not limited to this. In the terminal crimping device and the terminal crimping method according to the present invention, the number of terminals belonging to one terminal set and collectively performed can be set arbitrarily as long as crimp-connecting two or more terminals together as a terminal set.

Further, in the above-described embodiment, the terminal connector 2 in which the plurality of terminals 22 that is female type is connected by the carrier 21 is illustrated as the terminal coupled body according to the present invention. However, the terminal coupled body referred to in the present invention is not limited to this. The terminal coupled body according to the present invention is such that a plurality of terminals each of which is a male-type terminal is coupled by the carrier.

Further, in the embodiment described above, as an example of the terminal conveyance part according to the present invention the terminal conveyance part 13 is illustrated which conveys the two terminals 22 to the crimp position while shortening the terminal interval between the two terminals 22 belonging to the terminal set 23. However, the terminal conveyance part according to this invention is not limited to this. The terminal conveyance part in the invention may extend the terminal interval or may selectively set shortening and extension of the terminal interval as far as conveying the terminal to the crimp position corresponding to the interval while adjusting the terminal interval to the interval of the electric wire.

REFERENCE SIGNS LIST

1 terminal crimping device
2 terminal coupled body
3 multicore cable
11 terminal coupled body conveyance part
12 cutting part
13 terminal conveyance part
14 electric wire setting part
15 crimping part
16 drive control part
21 carrier
22 terminal
23 terminal set
31 covered wire
32 insulation sheath
121 lower part
122 upper part
131 pedestal part
132 terminal holding arm
132*a* groove
141 electric wire holding part
151 anvil
151*a* support base
152 crimper
152*a* conductor crimper
152*b* covered crimper
211 one side edge
221 electric connection part
222 conductor crimp part
223 cover crimp part
311 conductor
D11 extension direction
D12 conveyance direction
D13 crimp direction
D14, D15 arrow
D16 electric wire set direction
L11 terminal interval before shortening
L12 terminal interval after shortening

What is claimed is:

1. A terminal crimping device for crimp-connecting to an electric wire arranged at a predetermined interval each terminal of a terminal coupled body in which a plurality of terminals is connected such that each extends from one side edge of a band plate carrier, the terminal crimping device comprising:

a cutting part, provided that the plurality of terminals is divided into a plurality of terminal sets for every two or more terminals adjacent to each other, configured to cut from the carrier each of the two or more terminals belonging to one terminal set at one end side in the terminal coupled body;

a terminal conveyance part configured to convey the two or more terminals cut at the cutting part to a crimp position corresponding to the predetermined interval while adjusting a terminal interval of the two or more terminals to the predetermined interval in a longitudinal direction of the terminal coupled body; and a crimping part configured to collectively crimp-connect to the electric wire each of the two or more terminals conveyed to the crimp position.

2. The terminal crimping device according to claim 1, wherein the terminal interval of the plurality of terminals in the terminal coupled body is set wider than the predetermined interval of the electric wire, and the terminal conveyance part shortens the terminal interval of the two or more terminals to adjust the terminal interval to be the predetermined interval.

3. The terminal crimping device according to claim 1, wherein the terminal conveyance part includes two or more conveyance portions that individually convey each of the two or more terminals.

4. The terminal crimping device according to claim 2, wherein the terminal conveyance part includes two or more conveyance portions that move relative to each other from the cutting part to the crimp position and individually convey each of the two or more terminals.

5. The terminal crimping device according to claim 1, wherein the terminal conveyance part is configured to hold each of the two or more terminals before each of the two or more terminals is cut from the carrier by the cutting part, and after cutting, convey the two or more terminals to the crimp position while maintaining its holding state.

6. The terminal crimping device according to claim 2, wherein the terminal conveyance part is configured to hold each of the two or more terminals before each of the two or more terminals is cut from the carrier by the cutting part, and after cutting, convey the two or more terminals to the crimp position while maintaining its holding state.

7. The terminal crimping device according to claim 3, wherein the terminal conveyance part is configured to hold each of the two or more terminals before each of the two or more terminals is cut from the carrier by the cutting part, and after cutting, convey the two or more terminals to the crimp position while maintaining its holding state.

8. The terminal crimping device according to claim 4, wherein the terminal conveyance part is configured to hold each of the two or more terminals before each of the two or more terminals is cut from the carrier by the cutting part, and after cutting, convey the two or more terminals to the crimp position while maintaining its holding state.

9. The terminal crimping device according to claim 5, wherein the terminal conveyance part maintains the holding state until crimp-connection by the crimp part is completed.

10. The terminal crimping device according to claim 6, wherein the terminal conveyance part maintains the holding state until crimp-connection by the crimp part is completed.

11. The terminal crimping device according to claim 7, wherein the terminal conveyance part maintains the holding state until crimp-connection by the crimp part is completed.

12. The terminal crimping device according to claim 8, wherein the terminal conveyance part maintains the holding state until crimp-connection by the crimp part is completed.

13. The terminal crimping device according to claim 1, wherein the terminal conveyance part is configured to convey the two or more terminals so as to arrive at the crimp position at the same timing.

* * * * *